US008302762B2

(12) United States Patent
Mesquita et al.

(10) Patent No.: US 8,302,762 B2
(45) Date of Patent: Nov. 6, 2012

(54) DEFLECTING DEVICE FOR FLAT PRODUCTS

(75) Inventors: Cristovao Mesquita, Leonberg (DE); Martin Schweitzer, Schwieberdingen (DE)

(73) Assignee: Palamides GmbH, Renningen (DE)

( * ) Notice: Subject to any disclaimer, the term of this patent is extended or adjusted under 35 U.S.C. 154(b) by 0 days.

(21) Appl. No.: 13/166,290

(22) Filed: Jun. 22, 2011

(65) Prior Publication Data

US 2011/0315511 A1 Dec. 29, 2011

(30) Foreign Application Priority Data

Jun. 23, 2010 (DE) ..... 10 2010 025 224

(51) Int. Cl.
*B65G 15/14* (2006.01)

(52) U.S. Cl. ..... 198/626.6; 198/626.3; 198/606

(58) Field of Classification Search ..... 198/604, 198/606, 607, 612, 626.1, 626.3, 626.5, 626.6; 414/790.7, 790.8, 796.9, 790.2, 792.9; 271/177
See application file for complete search history.

(56) References Cited

U.S. PATENT DOCUMENTS

| | | | | |
|---|---|---|---|---|
| 3,691,942 | A * | 9/1972 | Wagley | 198/626.6 |
| 4,050,467 | A * | 9/1977 | Van Sluis et al. | 198/604 |
| 4,403,899 | A * | 9/1983 | Lampe et al. | 198/626.6 |
| 4,750,728 | A * | 6/1988 | Keller | 198/626.1 |
| 4,884,675 | A * | 12/1989 | Muraro et al. | 414/790.2 |
| 6,019,213 | A | 2/2000 | Schubert | |
| 6,120,240 | A * | 9/2000 | Ghilardi | 414/798.9 |
| 6,951,333 | B2 * | 10/2005 | Gosslinghoff | 271/177 |
| 7,124,877 | B2 * | 10/2006 | Honegger | 198/608 |

FOREIGN PATENT DOCUMENTS

DE 195 22 189 A1 1/1997

* cited by examiner

*Primary Examiner* — James R Bidwell
(74) *Attorney, Agent, or Firm* — Harness, Dickey & Pierce, P.L.C.

(57) ABSTRACT

The invention relates to a device for transporting flat products having at least one feeder feeding the flat products in a first transport direction, and having at least two conveying units for forwarding the flat products in a second transport direction. The conveying units are configured symmetrically and in each case have a plurality of guiding elements which can be set against the flat sides of the products. It is possible for the flat products to be received between in each case two adjacent guiding-element pairs and to be gripped by them and, as a result, to be transported upright in the second transport direction. During the movement in the second transport direction, the guiding elements are moved gradually out of holding engagement with the flat products.

13 Claims, 6 Drawing Sheets

DEFLECTING DEVICE FOR FLAT PRODUCTS

BACKGROUND OF THE INVENTION

The present invention relates to a device for transporting flat products from a first transport direction to in a second transport direction.

Devices of this type are used, for example, by relatively large companies with a large amount of mail items. These companies include, for example, large telecommunications enterprises with a large number of invoices to be sent, insurance enterprises, enterprises which use a lot of advertising and have a large amount of letter post to be sent, which is to be produced, placed in envelopes and sent automatically.

To this end, the letters, after they have been printed, are transferred automatically into envelopes in what is known as an enveloping machine, and the envelopes are subsequently sealed. In this form, the envelopes come out of the enveloping machine with different types of contents, that is to say both letters with many and few pages, brochures with a thick folded edge and the like.

After this, the letters as a rule already pass onto a conveyor belt, after which they are picked up manually by persons standing at this conveyor belt, according to certain criteria, and are transferred into transport boxes.

These transport boxes are then delivered correspondingly to the respective mail or delivery enterprise which then deals with the dispatch of the corresponding letters. In order that the outlay at the corresponding letter delivery enterprise is kept as low as possible, presorting into the corresponding transport baskets is already carried out by the abovementioned persons. As has already been mentioned, this takes place according to corresponding criteria. Here, these criteria can be related, in particular, to the address information, with the result that, for example, presorting according to zip code regions can already take place. This sorting can be designed to be differentiated in various ways, with the result that even very precise sorting can take place, depending on the amount of letters.

In order for it to be possible to perform the division into, for example, corresponding zip code regions, the persons which perform the sorting act in the simplest case in such a way that they read the corresponding zip codes on the letters which have been placed into envelopes. In order to facilitate this very laborious and wearisome work, corresponding markings are frequently inserted in the address field of the letters depending on the zip code regions. These markings can then either help the corresponding sorting person to detect different zip code regions more quickly, or can be configured in such a way that they are detected electronically by a scanner. The latter then ensures by way of a separate unit that, for example, the letters are transported in the continuous stream with a slight offset on the belt, at which a transition occurs from one zip code region to the next. This offset can then be detected readily by the sorting persons, with the result that, for example they only need to pick up the letters between one offset and the next, without having to concentrate further on the respective address fields. In addition to the separate markings, a scanner of this type can of course also read the zip codes directly by character recognition.

Transporting and sorting operations of this type can also be necessary for other flat products such as cartons, blanks, folding boxes, plates, dividing plates, for example made from plastic, paper, cardboard or metal, if they are delivered in relatively large numbers from a preliminary station, but are to be processed further in different packet sizes.

All flat products of this type have side edges which lie opposite one another, as viewed over their surface. Here, they do not necessarily have to run in a straight line, but rather can also be curved.

This manual sorting and transferring into corresponding transport containers is relatively expensive and prone to errors. An alternative, in which this transferring of the product coming from a station connected in front into a transport container is carried out automatically, is therefore very highly desirable.

To this end, however, it is necessary that the flat products which as a rule lie horizontally are sorted and are moved, in particular, into an upright, preferably perpendicular position. The products are later also present in an orientation of this type in the respective transport container.

The transfer of entire packets, that is to say of accumulations of products which are transported on a transport belt in a lying and preferably already presorted manner, into a transport container by separate devices having, for example, grippers affords only few advantages over the manual method, as has previously been used. Slipping and mixing up of the envelopes which have optionally already been sorted before can also occur here.

These problems are found not only in the handling described above in detail of envelopes, but generally in the case of all flat products which are to be sorted.

It is therefore an object of the present invention to provide, irrespectively of whether sorting of the products takes place in a horizontally oriented stream of products or in a stream of products oriented in an upright manner, a device in order to make it possible to transfer a corresponding horizontal stream of products, as it comes, for example, from an enveloping machine, into an upright, preferably perpendicular position, preferably allowing a separate further transport of the flat products for the purpose of accuracy and the reduction of fault sources.

SUMMARY OF THE INVENTION

This object is achieved by a device for transporting flat products comprising at least one feeder for feeding said flat products in a first transport direction, and at least two conveying units for receiving and for forwarding said flat products in a second transport direction running perpendicularly with respect to the first transport direction, said first and second transport direction defining a plane, said conveying units being configured symmetrically with respect to said plane, said flat products comprising two flat sides, each of said conveying units comprising a plurality of guiding elements being capable of being set against said flat sides, wherein a first guiding element of one conveying unit and a second guiding element of another conveying unit are arranged symmetrically to each other with respect to said plane, said first and second guiding elements forming a guiding-element pair, and wherein said flat products are received between two adjacent guiding-element pairs in a holding engagement thereby gripping said flat products and transporting said flat products in said second transport direction with their flat sides being upright with respect to said second transport direction, said guiding elements being capable of moving gradually out of said holding engagement with said flat products during said transporting of said flat products in said second transport direction.

This device which is configured in this way first of all permits separated receiving of the flat products by the corresponding adjacent guiding-element pairs.

As a result of the ability of the guiding elements of the guiding-element pairs to be set against the flat sides of the products, in addition to the ability based on this of gripping the flat products and thus transporting them further upright, there is, furthermore, a flexibility in relation to the width of the flat products, as seen in the direction of the second transport direction.

As mentioned before, the first transport direction exhibits substantially lying transport of the flat products, while they are transported upright in the second transport direction according to the invention.

The ability of moving the guiding elements apart in such a way that the holding engagement with the flat products is ultimately terminated has the advantage that a continuous transition is provided to the further following transport devices which can receive the flat products from this moment of the termination of the holding engagement with the guiding elements.

The symmetrical configuration of the two conveying units has the advantage that they can be constructed substantially from the same components.

In a further embodiment of the invention, the flat products can be received at two opposite ends between two respective guiding elements of a conveying unit.

These ends can be the left-hand and the right-hand ends or the upper and lower ends. The selection of these opposite ends depends on the following transport device.

This measure has the advantage that the interaction between the conveying units and the flat products to be transported is minimized by the receiving at opposite ends. This has a positive effect on the required time and on a reduction in the impairment of the material and of the surfaces of the flat products by the conveying units.

In a further embodiment of the invention, the two conveying units are oriented with respect to one another in such a way that the two guiding elements of a guiding-element pair are spaced further apart from one another in their position during the forwarding of the products than during the receiving of the products, and, during the transporting of the products, the guiding elements can be moved gradually laterally out of holding engagement with the flat products.

This measure has the advantage that the abovementioned moving apart out of the holding engagement takes place by a lateral movement of the holding guiding elements in each case to the outside. This leads to the flat products being less and less in contact with the guiding elements during the transporting in the second transport direction. This goes so far until the contact during the forwarding of the products is preferably such that at least the foremost guiding elements as viewed in the transport direction no longer participate in the holding engagement with the flat products. A corresponding flat product can therefore be forwarded to a following transport device in an unimpeded manner. The continuous lateral moving apart during the transition from the position of receiving to the position of forwarding the flat products has the advantage that there is a continuous process of releasing the product, which process can be introduced into a continuous transport process of a larger overall device.

In a further embodiment of the invention, the guiding elements have a plate-shaped element and, at least on one side of this plate-shaped element, a resilient clamping element.

This measure has the advantage that plate-shaped elements represent a design of guiding elements which is simple to produce and to mount. Flat products can also be arranged very satisfactorily between them. Moreover, the provision of resilient clamping elements on at least one side has the advantage that the flat products can also be transported in a holding manner between the corresponding guiding elements. It is not additionally necessary here to provide a support underneath, since the holding engagement is preferably sufficient for the weights of the prevalent flat products and therefore carries them.

In a further embodiment of the invention, the conveying units in each case have at least one chain, on which the guiding elements are arranged; here, the guiding elements are preferably arranged on the chain via holders, the holders preferably connecting in each case one guiding element to a chain link.

This measure is advantageous, in particular, for the abovementioned continuous operation. In this context, a corresponding chain according to the invention is represented by an endless belt, on which the corresponding guiding elements are arranged. Here, on account of the holder, the guiding elements can be arranged on the chain in such a way that the guiding elements which are present on the side which faces the flat products are oriented ideally for receiving the flat products in a manner according to the invention and for gripping the flat products in a manner according to the invention. Furthermore, as a result, they can also afford a possibility for receiving the flat products during pivoting into this region, in the same way as releasing the flat products again when the latter are forwarded. On account of its chain links, furthermore, a chain of this type affords satisfactory possibilities for arranging the corresponding guiding elements via holders according to the invention. Furthermore, a chain can also be actuated precisely by gearwheels, for example. Moreover, chains are also ideally suitable for having their length adapted according to the requirements for the device according to the invention. Moreover, their course can also be adapted according to the wishes and requirements by selection of corresponding gearwheels and deflection.

In a further embodiment of the invention, the chains have an oval circumferential contour, the longer axes of the oval circumferential contours of the respective chains diverging in the direction of the second transport direction.

This measure has the advantage that this arrangement of the chains with respect to one another makes it possible in a simple way that two guiding elements of a guiding-element pair which are arranged on in each case one chain and can hold the flat products are moved apart from one another at the same time by being moved forwards with the chains. The construction of the device according to the invention is therefore kept very simple and favourable.

In a further embodiment of the invention, the chains of the conveying elements in each case have at least one rectilinearly extending section on the sides which face one another.

This measure has the advantage that this arrangement of the respective chains permits a parallel arrangement of the guiding elements with respect to one another which are situated in this section and, as a consequence, also permits a parallel orientation of the flat products with respect to one another, which flat products are held by the relevant guiding elements. This therefore makes it possible in a simple way that the products can be transported in an optimally oriented manner from receiving to forwarding and can be transferred correspondingly to further following transport devices.

In a further embodiment of the invention, the guiding elements of the two conveying units can be moved synchronously.

This measure has the advantage that the synchronous movement makes it possible that actually always one guiding-element pair which comprises two guiding elements which lie opposite one another can be moved further in the transport direction in coordination with one another. As a result, parallel transporting of the flat products within the present device is ensured. Furthermore, buckling and canting of the flat products are avoided.

In a further embodiment of the invention the device also has at least one transport unit with at least one transport element for transporting the flat products further, by which transport unit the flat products can be received during the forwarding from the conveying devices.

This measure has the advantage that continuous receiving of the released flat products to be transported is ensured by the transport unit which adjoins the conveying device directly. This transport unit can then be designed in such a way that, for example, sorting, as has been described before, can take place by way of it. Furthermore, this transport unit can also be designed in such a way that a transfer of the flat products into corresponding transport containers can take place via the said transport unit or a further transport unit which follows it.

In a further embodiment of the invention, the conveying units and the at least one transport element of the at least one transport unit can be moved synchronously.

This measure has the advantage that, in particular, the release of a respective flat product by the two conveying units can take place at the same time as the receiving of the flat product by the transport unit which is connected behind it. As a result, both damage of the flat product and also loss of this flat product, by falling down, for example, are suppressed.

Furthermore, the object of the present invention is achieved by a method for transporting flat products with a device in accordance with the aforementioned embodiments, comprising the following steps:

- receiving of said flat products from a first transport direction between two guiding-element pairs each comprising two guiding elements,
- transporting of said flat products held between said guiding-element pairs in a second transport direction running perpendicularly with respect to said first transport direction,
- continuous lateral moving apart from another of said two guiding elements during transporting in said second transport direction, and
- disengaging of said flat product by a foremost guiding-element pair, as viewed in said second transport direction, said foremost guiding-element pair has been moved completely apart, and forwarding of said flat product by a following transport unit.

As a result of the basic principle which is found again in this method according to the invention, it is then possible to deflect flat products, such as envelopes, which are transported, for example, in a horizontal direction, into a second transport direction individually or else in small packets. This second transport direction can preferably then exhibit upright, preferably perpendicular further transport of the flat products. Here, it is ensured in this method that homogeneous forwarding of the flat products takes place by the moving apart of the guiding elements taking place, as a result of which the products are released and subsequently the respective flat product is transferred continuously at the end to a further transport unit.

It will be appreciated that the aforementioned features and the features still to be explained below can be used not only in the respectively specified combination, but also in other combinations or alone, without departing from the scope of the present invention.

BRIEF DESCRIPTION OF THE DRAWINGS

The invention is described and explained in more detail below on the basis of a number of selected exemplary embodiments and with reference to the attached drawings, in which.

DETAILED DESCRIPTION OF PREFERRED EMBODIMENTS

Figure 1:
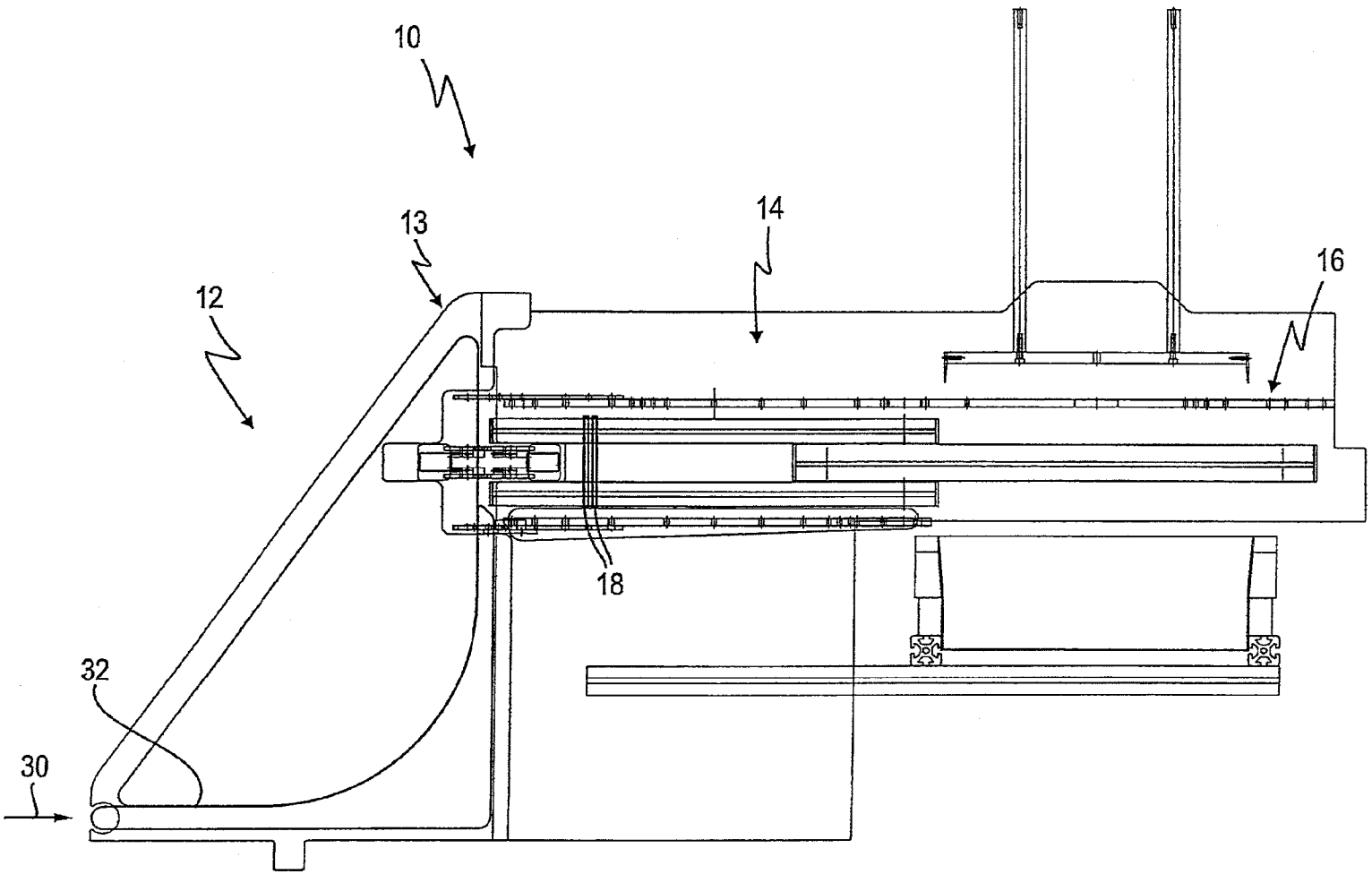
FIG. 1 shows an overall side view of a device according to the invention.

A device which is explained in more detail in the following description and is shown in the figures is designated in its entirety by the reference numeral 10.

This device 10 has a feeder 12, a linear conveying device 13, a first transport unit 14 and a second transport unit 16. This can be gathered, in particular, from the illustration of FIG. 1.

The feeder 12 receives flat products 18 which come from a station connected upstream, as will be described in more detail in conjunction with the following figures. If an enveloping machine is used as an example, it serves to transfer machine-printed letters into envelopes and to close the latter. It discharges the envelopes subsequently as a rule lying horizontally on a transport belt, according to the illustration of FIG. 1. They thus pass into the feeder 12 in accordance with a feed direction which is shown there by an arrow 30.

Furthermore, the feeder 12 has a transport belt 32. The said transport belt 32 receives the flat products 18 from the feed direction 30 and moves them into an upright oriented position, meaning that their flat sides are upright with respect to a following second transport direction 54, in accordance with its bent course which can be seen in FIG. 1. They are received there by the linear conveying device 13.

The said linear conveying device 13 ensures that the flat products 18 which are now upright are transferred to the first transport unit 14. In accordance with the illustration of FIG. 1, the flat products 18 are preferably perpendicularly upright here.

Figure 1A:
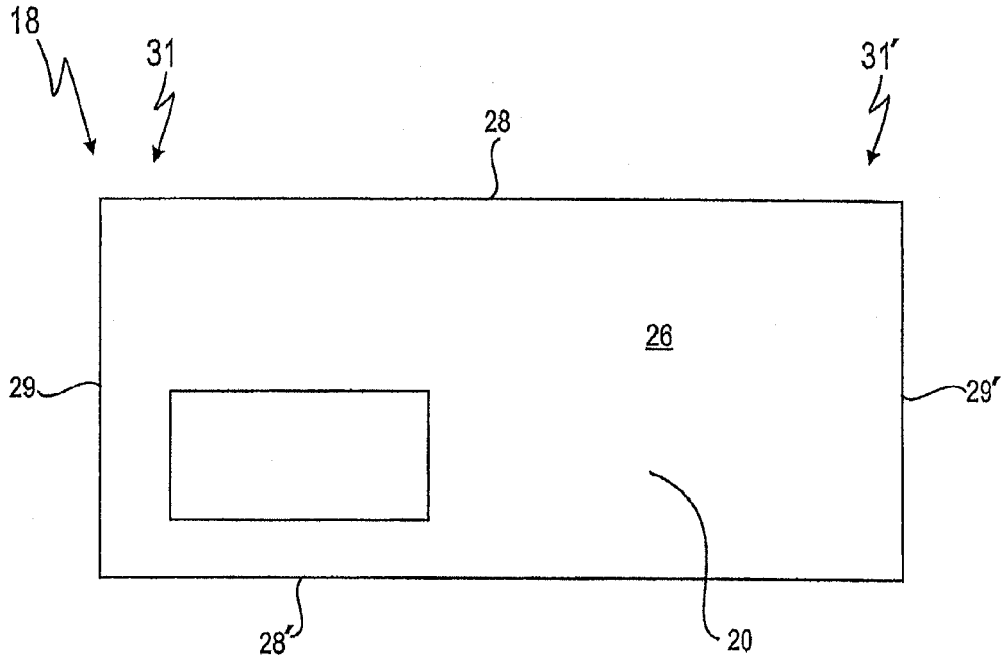
FIGS. 1*a* and 1*b* show a diagrammatic illustration of a flat product.
Figure 1B:
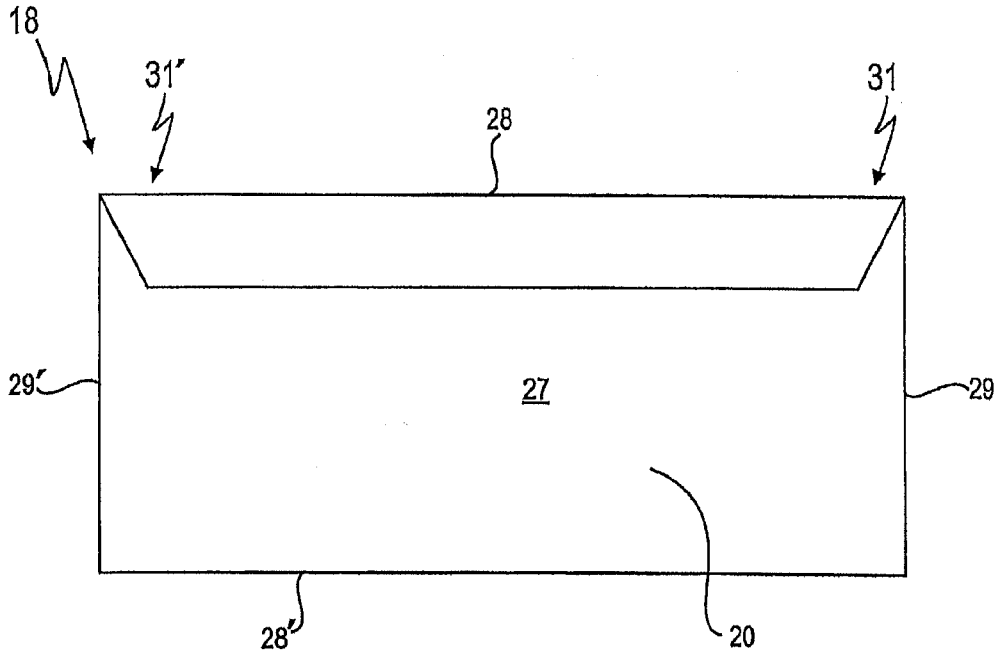

An exemplary flat product 18 is seen in FIGS. 1*a* and 1*b*. This flat product 18 is an envelope 20 in this exemplary embodiment. The envelope 20 has two flat sides, a front side 26 and a rear side 27. Furthermore, it has an upper edge 28 and a lower edge 28' and side edges 29 and 29'. These side edges 29 and 29' form the respectively outermost edge of opposite ends 31 and 31' of the flat product 18 or envelope 20.

It goes without saying that these designations are primarily to be understood as relative specifications in relation to the usual use and the usual operation of a device according to the invention and the associated orientation of the flat products 18. Orientation-independent commitment to the designations shown for the envelope 20 is not desired here, but rather a corresponding adaptation of the designations is to be performed if, for example, the envelope 20 is present in the device with an orientation turned by 180°. Thus, for example, the upper edge shown here would then become the lower edge and vice versa, and the front side would correspondingly become the rear side and vice versa.

If envelopes 20 are spoken of before or below, this serves merely for illustration using an exemplary embodiment. In general and in relation to the concept of the invention, it goes without saying that generally all flat products 18 can also be used for this purpose.

Figure 2:
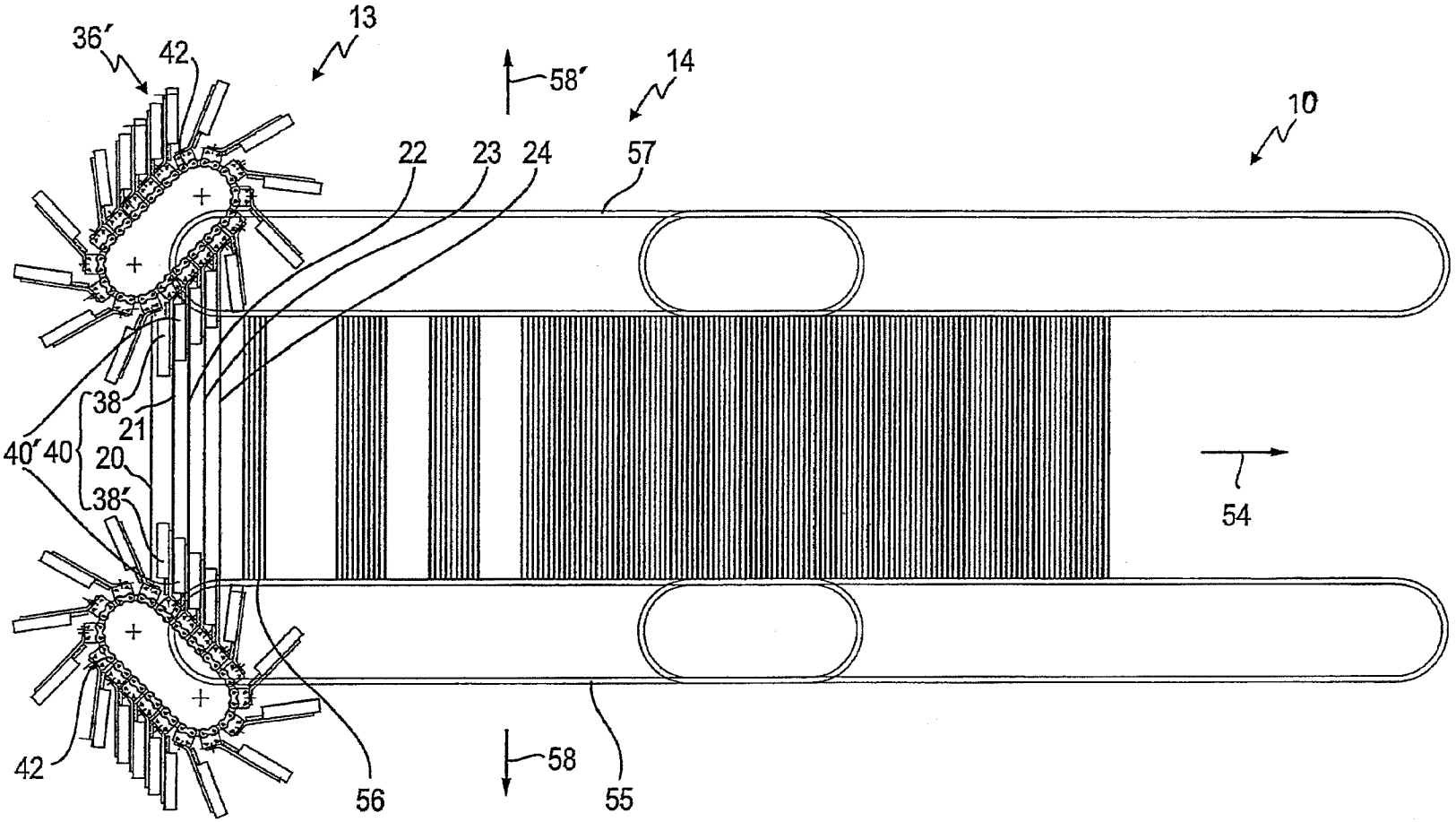
FIG. 2 shows a detailed plan view of a device according to the invention, including a further transport unit connected downstream.
Figure 2A:
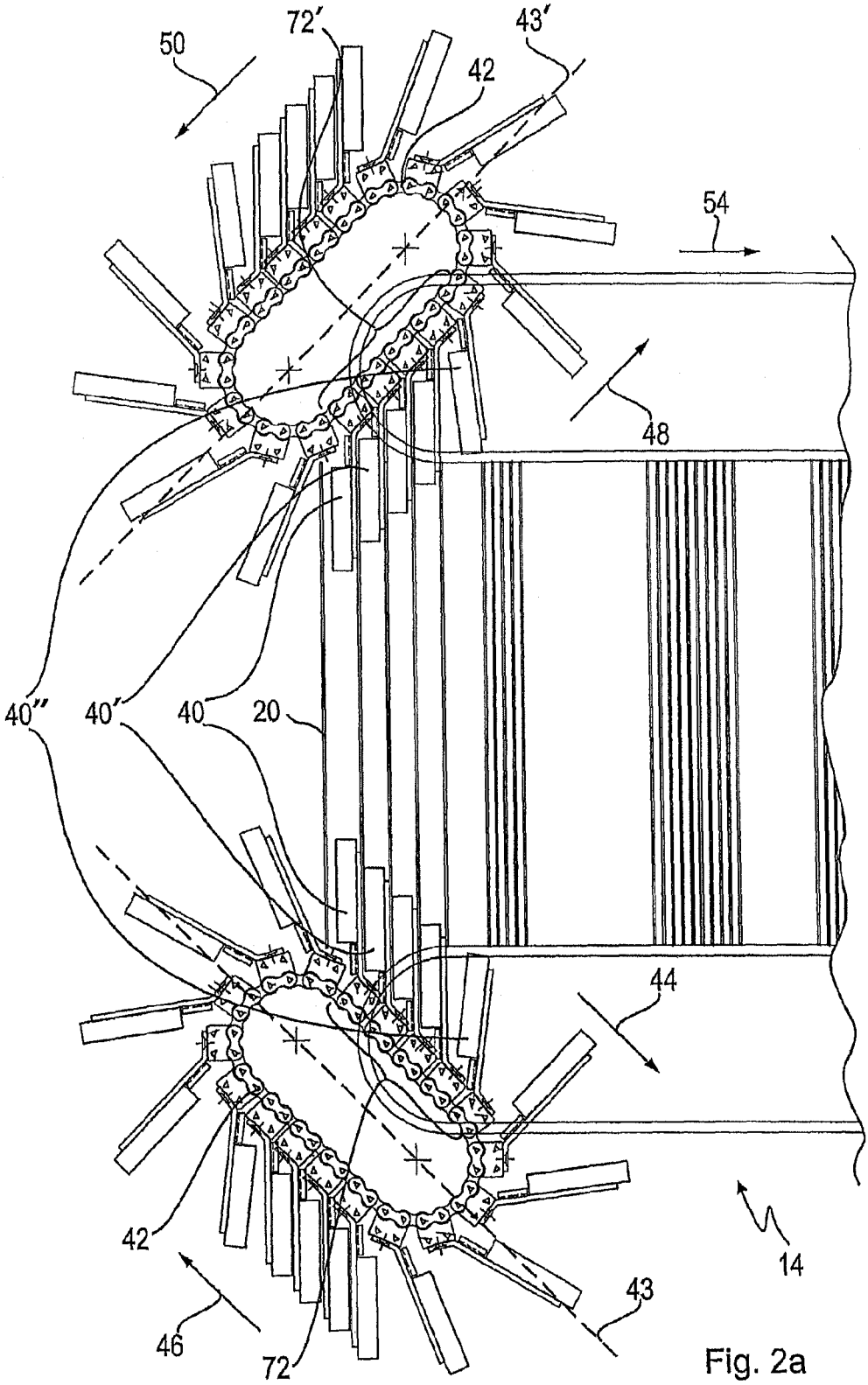
FIG. 2*a* shows details of an enlarged view of the device from FIG. 2.
Figure 3:
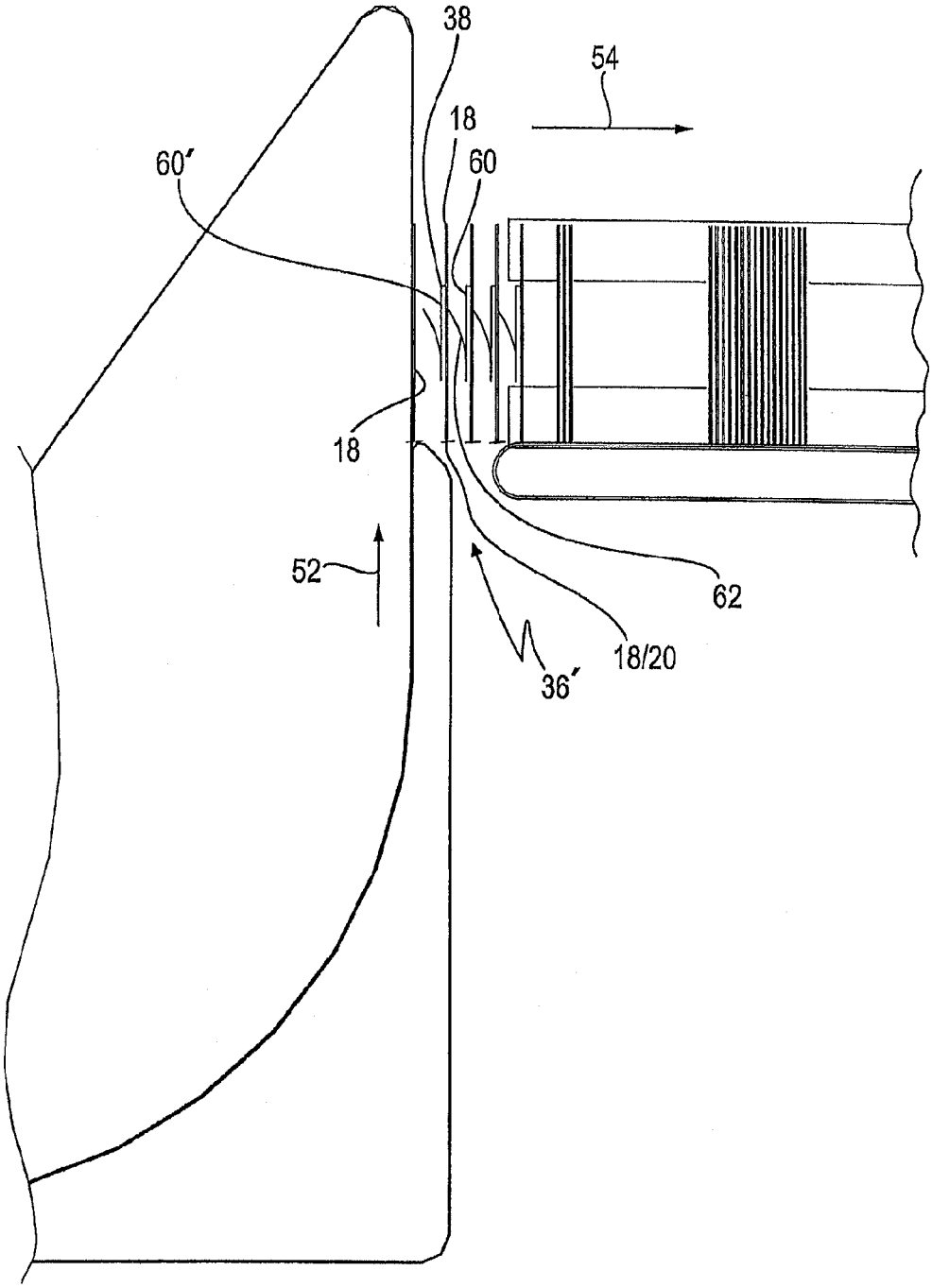
FIG. 3 shows details of a sectional view in accordance with the illustration in FIG. 1.

It can be seen, in particular, from FIGS. 2, 2*a* and 3 how the transfer from the linear conveying device 13 into the first transport unit 14 takes place.

It can be seen here in conjunction with FIG. 2 that the linear conveying device 13 has two conveying units 36 and 36'.

These conveying units 36 and 36' themselves have in each case guiding elements 38, two guiding elements 38 and 38' which lie opposite one another forming a guiding-element pair 40. Furthermore, the conveying units 36 and 36' in each case have a chain 42, on which the guiding elements 38, 38' are arranged.

In accordance with the illustration of FIGS. 2 and 2*a*, these chains have an oval shape. They therefore exhibit an oval circumferential contour. Here, they are oriented with respect to one another in such a way that the respective longer axes which are indicated in FIG. 2*a* by the dashed lines 43 and 43' diverge as viewed in the transport direction 54.

As can be seen, in particular, in conjunction with FIG. 3, the flat products 18 from a first transport direction 52 are introduced between the conveying units 36 and 36'.

The further transport within the conveying units 36, 36' and in the further course also in the transport units 14 and 16 then takes place in a second transport direction 54.

To this end, the flat products, for example envelopes 20, which are introduced between the conveying units 36 and 36' are gripped in a holding manner between a first guiding-element pair 40 and a front second guiding-element pair 40' in the transport direction 54. This takes place, in particular, by virtue of the fact that the respective guiding elements 38, 38' are set against the flat sides of the products 18, preferably in the region of the respective ends 31 and 31' which lie opposite one another. Here, as a result, the flat sides are to be understood as the front side 26 and the rear side 27 of a respective product 18.

In the case of an orientation of the envelope 20 or of the flat product 18, in which the front side 26 also looks to the front in the second transport direction 54, the guiding elements 38, 38' of the front guiding-element pair 40' then bear against the front side 26 and the guiding elements 38, 38' of the rear guiding-element pair 40 bear against the rear side 27.

In a next step, the chains 42 move in the directions which are indicated by arrows 44 to 50. Here, the guiding-element pairs 40 and 40' drive the corresponding envelope 20 in the second transport direction 54 in a holding manner.

In accordance with the comments made above, a flat product 18 is thus transported further and is released more and more from the guiding elements 38 by the latter moving to the outside. This can be comprehended using FIGS. 2, 2*a* and 3 with the envelopes 20 to 24 which are shown there. Each of these envelopes 20 to 24 is arranged at a different step in the transport direction 54 as far as to the forwarding to a following transport unit 14.

While envelope 20 is still free at the instant of the receiving, as an envelope which is fed in directly by the feeder 12, the front envelope 21 is already one step further and is held in a carrying manner between the guiding-element pairs 40 and 40'.

As can be seen, in particular, from FIG. 2, the guiding elements 38 which lie further forwards as viewed in the transport direction 54 and in each case hold the following envelopes 22 and 23 are moved apart laterally gradually out of the holding engagement with these envelopes. Here, the guiding-element pair 40" forms the end, which guiding-element pair 40" has previously delimited the envelope 24 to the front in the transport direction 54 but has then moved completely out of the holding engagement. It is additionally opened slightly in the present exemplary embodiment.

The envelope 24 is then no longer situated in holding engagement with the conveying units 36 and 36' at this instant. In contrast, it is then situated in holding engagement with transport elements 55 and 57 of the first transport unit 14.

For this receiving and forwarding of the envelopes 20 by the conveying units 36 and 36', it can be seen particularly in the sectional view of FIG. 3 that the envelopes 20, or in general the flat products 18, are held between the guiding elements 38 in such a way that no additional support from underneath is necessary in relation to the illustration of FIG. 3. Here, the flat products 18 are clamped in between the guiding elements 38 of the conveying units 36 and 36'.

This becomes possible as a result of the construction of the guiding elements 38, which will be explained in greater detail below with reference to FIGS. 3 and 4.

Figure 4:
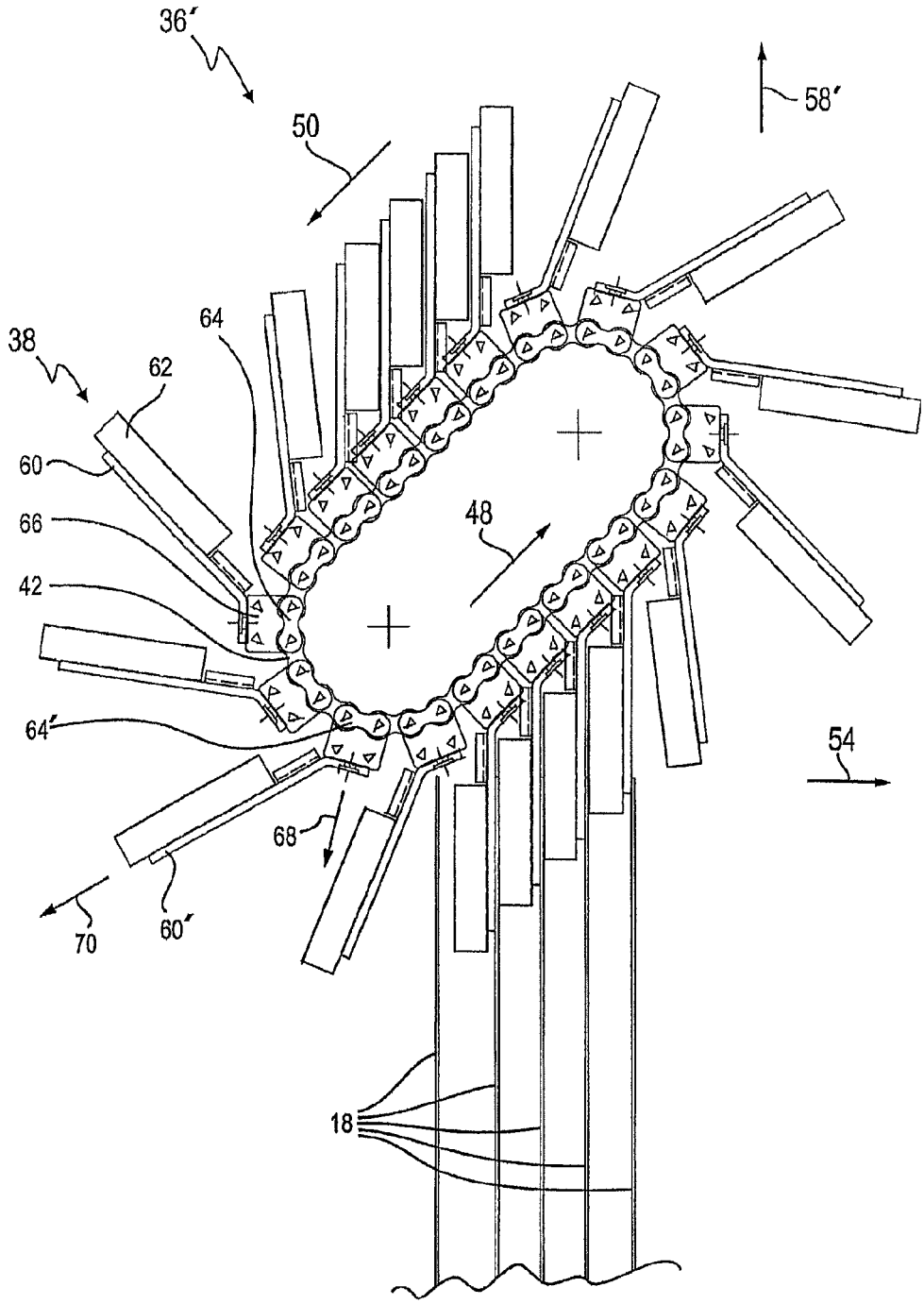
FIG. 4 shows details of an enlarged illustration of a conveying unit according to the invention from FIG. 2.

As can be seen well in FIG. 4, a guiding element 38 has, inter alia, a plate-shaped element 60 and a resilient clamping element 62. With reference to the second transport direction 54 and the guiding elements 38 of the conveying unit 36' shown in FIG. 4 which participate in the respective transport, the resilient clamping element 62 is arranged on the rear side of the plate-shaped element 60 in this embodiment. In this context, front and rear are used with reference to the second transport direction 54. Apart from the exemplary embodiment which is selected here, there is also provision for it to be possible for the resilient clamping element 62 to be arranged correspondingly on the front side of the plate-shaped element 60. Furthermore, it is also conceivable within the scope of the present invention that two resilient clamping elements 62 are arranged on the front and rear sides of the plate-shaped element 60. The resilient clamping elements 62 can be for example any elastic material formed as a thin plate or the like, e.g. a thin metal or plastic plate, that shows spring-like characteristics in order to clamp and hold said flat products 18. A specific example for this would be a leaf spring.

The chain 42, on which the guiding elements 38 are arranged, has a plurality of concatenated chain links 64. Holders 66 are arranged on these chain links 64. In turn, the plate-shaped elements 60 of the guiding elements 38 are arranged via these holders 66.

As can be seen, in particular, in FIG. 4, the plate-shaped elements 60 are arranged obliquely on the chain links 64. This is shown by way of example in FIG. 4 for the chain link 64' and the plate-shaped element 60'. Here, an arrow 68 indicates an axis which is perpendicular with respect to the longitudinal axis of the chain link 64'. In contrast, an arrow 70 represents the longitudinal axis of the plate-shaped element 60'. The comparison of the arrows 68 and 70 shows that the arrangement of the plate-shaped element 60 and therefore also of the entire guiding element 38 is carried out obliquely on the respective chain links 64.

This above-described oblique arrangement ultimately leads to the guiding elements 38 with their plate-shaped elements 60 being oriented perpendicularly with respect to the second transport direction 54 despite the oblique course of the chain 42 on the side which faces the flat products 18, as is indicated by the arrow 48. This perpendicular orientation then makes the receiving of the flat products 18 between two guiding elements 38 possible, as has been described in more detail before.

The oblique course according to the arrow 48 on the side which faces the flat products 18 is provided, in order to make the moving apart, likewise already described in greater detail above, of the guiding elements 38 possible laterally and perpendicularly with respect to the second transport direction 54, in accordance with the direction of an arrow 58' for the conveying unit 36' and of an arrow 58 for the conveying unit 36.

The rear-side course of the chain 42 on the side which faces away from the flat products 18 takes place in the present exemplary embodiment, in accordance with the previous suggestion, simply in an opposite manner to the side which faces the flat products 18. This is indicated by an arrow 50 or 46. Apart from the present exemplary embodiment, however, it is also conceivable here that, precisely on the side which faces away from the flat products, any desired course of the chain 42 can be selected, since these guiding elements 38 which are situated on the side which faces away from the flat products 18 have no effect on the flat products 18 or the above-described transport.

As can be seen well in conjunction with FIG. 3, the above-described resilient clamping elements 62 are arranged on the plate-shaped elements 60 in such a way that they have a barb function. A flat product 18 which arrives from the first transport direction 52 can thus be introduced, coming from below in relation to FIG. 3, counter to a spring prestress of the resilient clamping element 62 of the plate-shaped element 60. Thereupon, this resilient clamping element 62 presses the flat product 18 against the following plate-shaped element 60'. The barb-like design or arrangement of the resilient clamping element 62 on the plate-shaped element 60 thus makes it possible that falling down or slipping of the flat product 18 in the opposite direction to the first transport direction 52 does not take place.

As can be comprehended in accordance with the previously made description, the device which is shown in FIGS. 1 to 4 is configured in such a way that the two conveying units 36 and 36' can be moved synchronously. This means that, during the operation of the respective chains 42, they are firstly operated at the same speed, but secondly it is also ensured that the orientation of two guiding elements 38 and 38' of a guiding-element pair 40 is always such that, on the side which faces the flat products 18, they are arranged in such a way that the guiding elements 38 or the plate-shaped elements 60 which are associated with them form a plane which extends perpendicularly with respect to the second transport direction 54. As a result, a flat product 18 can then correspondingly be received upright and can preferably be transported perpendicularly in the transport direction 54. This means also perpendicularly with their flat sides 26 and 27.

Furthermore, the conveying units 36 and 36' are configured in such a way that they are configured and oriented symmetrically to one another in relation to a plane which is defined by the transport directions 52 and 54. This then also applies to a guiding-element pair 40, that is to say to respective guiding elements 38 and 38' which together form a pair of this type. A uniform and mutually parallel transport of the flat products 18 or of the envelopes 20 is ensured and implemented.

Furthermore, this is facilitated by the fact that the chains 42, as can be seen in FIGS. 2 and 2*a*, have a rectilinear course in a respective section 72, 72', in which the flat products 18 are received and transported by the conveying units 36 and 36'.

With reference to the explanations made above, the method according to the invention is to be described briefly once more in summary in the following text.

Here, first of all a flat product 18, coming from a first transport direction 52, is received between two guiding-element pairs 40 and 40'. On account of the movement of the chains 42, shown by the arrows 44 to 50, these guiding-element pairs 40 and 40' move further in such a way that the flat products 18 which are received between them are driven and transported in a second transport direction 54.

The transport direction 54 runs substantially perpendicularly with respect to the first transport direction 52.

As has also already been described above, the guiding elements 38 and 38' of a respective guiding-element pair 40 move further and further apart as they advance in the transport direction 54, as is indicated by the arrows 58 and 58'. This leads to the flat products 18, or envelopes 20 here, ultimately being released by the guiding elements 38, 38'. This is shown, for example, in FIG. 2 and FIG. 2*a* for the front guiding-element pair 40" which has then released the envelope 24 again in the situation which is shown there. As can likewise be seen in FIGS. 2 and 2*a*, a transfer of the flat product 18, here of the envelope 20, ideally takes place at this point into a following first transport unit 14 which has the transport elements 55 and 57 in the present example. Here, the envelope 24 is received in a holding manner by the transport elements 55 and 57 which are preferably transport belts, by setting of these transport elements 55 and 57 against the side edges of the envelope 24.

This is followed by continuous further transport of the flat product 18, the envelope 24 here, in the second transport direction 54. Here, the flat product 18 is oriented upright and preferably perpendicularly. This means upright with its flat sides 26 and 27 and perpendicularly with respect to the second transport direction 54.

What is claimed is:

1. A device for transporting flat products comprising:

at least one feeder for feeding said flat products in a first transport direction, and at least two conveying units for receiving and for forwarding said flat products in a second transport direction running perpendicularly with respect to the first transport direction, said first and second transport direction defining a plane, said conveying units being configured symmetrically with respect to said plane, said flat products comprising two flat sides, each of said conveying units comprising a plurality of guiding elements being capable of being set against said flat sides, wherein a first guiding element of one conveying unit and a second guiding element of another conveying unit are arranged symmetrically to each other with respect to said plane, said first and second guiding elements forming a guiding-element pair, and wherein said flat products are received between two adjacent guiding-element pairs in a holding engagement thereby gripping said flat products and transporting said flat products in said second transport direction with their flat sides being upright with respect to said second transport direction, said guiding elements being capable of moving gradually out of said holding engagement with said flat products during said transporting of said flat products in said second transport direction.

2. The device of claim 1, wherein said flat products, having at least two opposite ends, are received between two guiding elements of a conveying unit with one of said opposite ends, respectively.

3. The device of claim 1, wherein said two conveying units are oriented with respect to one another in such a way that said two guiding elements of said guiding-element pair are spaced further apart from one another during said forwarding of said flat products than during said receiving of said flat products, and, wherein said two guiding elements of said guiding-element pair are capable of moving gradually laterally out of said holding engagement with said flat products during said transporting.

4. The device of claim 1, wherein said guiding elements comprise a plate-shaped element comprising a resilient clamping element on at least one side.

5. The device of claim 1, wherein each of said conveying units has at least one chain, said guiding elements are arranged on said chains.

6. The device of claim 5, wherein said guiding elements are arranged on said chains via holders.

7. The device of claim 6, wherein said chain comprises chain links, said holders connecting one of said guiding elements to one of said chain links.

8. The device of claim 5, wherein each of said chains comprises an oval circumferential contour, each of said oval circumferential contours comprises a longer axis, said respective longer axes diverging in the direction of said second transport direction.

9. The device of claim 5, wherein each of said chains of said conveying units comprises at least one rectilinearly extending section on the side which faces the other conveying unit.

10. The device of claim 1, wherein said guiding elements of said two conveying units can be moved synchronously.

11. The device of claim 1, further comprising:

at least one transport unit comprising at least one transport element for further transporting said flat products, said transport unit is capable of receiving said flat products during said forwarding from said conveying units.

12. The device of claim 11, wherein said conveying units and said at least one transport element can be moved synchronously.

13. A method for transporting flat products with a device according to claim 1, comprising the following steps:

receiving said flat products from a first transport direction between two guiding-element pairs each comprising two guiding elements, transporting said flat products held between said guiding-element pairs in a second transport direction running perpendicularly with respect to said first transport direction, continuously moving said two guiding elements of a guiding-element pair laterally apart during transporting in said second transport direction, disengaging of said flat product by a foremost guiding-element pair, as viewed in said second transport direction, said foremost guiding-element pair having been moved completely apart, and forwarding of said flat product by a following trans-port unit.

* * * * *